US005587702A

United States Patent [19]

Chadfield

[11] Patent Number: 5,587,702

[45] Date of Patent: Dec. 24, 1996

[54] PADLOCK WITH TAMPER ALARM

[76] Inventor: Garth R. Chadfield, Riverbank Road, RD 3, Wanganui, New Zealand

[21] Appl. No.: 433,482

[22] PCT Filed: Nov. 12, 1993

[86] PCT No.: PCT/NZ93/00112

§ 371 Date: May 11, 1995

§ 102(e) Date: May 11, 1995

[87] PCT Pub. No.: WO94/11603

PCT Pub. Date: May 26, 1994

[30] Foreign Application Priority Data

| | | | |
|---|---|---|---|
| Nov. 12, 1992 | [NZ] | New Zealand | 245107 |
| Apr. 6, 1993 | [NZ] | New Zealand | 247352 |

[51] Int. Cl.[6] ..... E05B 45/06

[52] U.S. Cl. ..... 340/542; 70/38 A; 70/38 B; 70/DIG. 49; 70/439

[58] Field of Search ..... 340/542, 568, 340/543, 432, 427; 70/52, 53, 38 A, 38 B, DIG. 49, 432–437, 439

[56] References Cited

U.S. PATENT DOCUMENTS

| | | | |
|---|---|---|---|
| 301,291 | 7/1884 | Smith | 70/52 |
| 883,414 | 3/1908 | Merrill | 70/52 |
| 3,879,721 | 4/1975 | Yereance | 340/542 |
| 3,993,987 | 11/1976 | Stevens | 340/542 |
| 4,112,715 | 9/1978 | Uyeda | 70/52 |
| 4,290,279 | 9/1981 | Fish et al. | 70/52 |
| 4,546,345 | 10/1985 | Naito | 340/542 |
| 4,556,872 | 12/1985 | Masoncup et al. | 340/542 |
| 4,811,578 | 3/1989 | Masoncup et al. | 70/38 B |
| 5,194,845 | 3/1993 | Sirmon et al. | 340/427 |
| 5,274,353 | 12/1993 | Bianchi | 340/427 |

FOREIGN PATENT DOCUMENTS

| | | |
|---|---|---|
| 307873A | 3/1989 | European Pat. Off. . |
| 413065A | 2/1991 | European Pat. Off. . |
| 1110397 | 2/1956 | France . |
| 2169343 | 7/1986 | United Kingdom . |
| 2224771 | 5/1990 | United Kingdom . |
| WO90/12182 | 10/1990 | WIPO . |

*Primary Examiner*—Jeffery Hofsass
*Assistant Examiner*—Benjamin C. Lee
*Attorney, Agent, or Firm*—Brooks & Kushman P.C.

[57] ABSTRACT

A padlock comprising a body and shackle, the shackle having an end releasably securable in the body, the body having a casing, the casing housing a tamper alarm means and a lock means, the tamper alarm means including a power supply means, the casing having an aperture configured and arranged to receive the end of the shackle being securable in the aperture by way of the lock means, a portion of the casing being movable to enable access to the power supply means, movement of the portion of the casing being prevented by a retaining means which is only accessible for insertion or removal via the aperture in the casing configured and arranged to receive the end of the shackle.

20 Claims, 5 Drawing Sheets

PADLOCK WITH TAMPER ALARM

TECHNICAL FIELD

This invention relates to a padlock, and more particularly, to a padlock which incorporates a tamper alarm.

BACKGROUND ART

Padlocks are typically used for securing possessions, such as bicycles, trailers etc against theft whilst their owners are absent, or for preventing unauthorised access to particular areas or locations.

However, padlocks generally do not present a significant barrier to a person seriously intent on theft or trespass. In this regard, even a moderately well equipped thief or trespasser usually possesses the wherewithal to sever or force the shackle of the padlock.

There are a number of known padlocks which include an integral alarm system adopted to sound or activate when the padlock is violated or tampered with. Representative of such prior art padlocks are those decribed in U.S. Pat. No. 3,993,987, 4,556,872 and 4,811,578.

All of the padlocks disclosed in the above U.S. Patent Specifications include an audible alarm sounding device, a battery for energizing the audible alarm sounding device and an electrical circuit having switches connecting the audible alarm sounding device to the battery for actuation when the padlock is tampered with or violated. A problem associated with all battery operated equipment is that the battery or batteries eventually wear out and, if use of the alarm function is to continue, must be replaced.

The padlocks described in the above noted U.S. Patent Specifications each include provision for access to the battery housed within the padlock body to enable removal and replacement. In each, however, such provision affords an obvious point at which to gain unauthorised access to the battery, remove it and thereby deactivate or disable the alarm.

It is an object of the present invention to provide a padlock incorporating a tamper alarm having features which reduce to at least some extent, as compared with the prior art, the opportunity for unauthorised deactivation of the tamper alarm.

SUMMARY OF THE INVENTION

In a broad aspect this invention provides a padlock comprising a shackle and a body, the shackle having an end releasably securable in the body, the body having a casing, the casing housing a tamper alarm means and a lock means, the tamper alarm means including a power supply means, the casing having an aperture configured and arranged to receive the end of the shackle, the end of the shackle being securable in the aperture by way of the lock means, a portion of the casing being movable to enable access to the power supply means, movement of the portion of the casing being prevented by a retaining means, characterised in that the retaining means is only accessable for insertion or removal via the aperture in the casing configured and arranged to receive the end of the shackle.

Preferably, the casing comprises two or more portions maintained in contiguity by the retaining means.

Desirably, the casing portions can interlock.

Optionally, the shackle is entirely separable from the body. In which situation the interlocking sections of the casing can be maintained in releasable interlocked engagement by way of a first and a second retaining means both locatable interior of the casing, the first retaining means only being accessable when interior of the casing through a first aperture in the casing, the first aperture being configured and arranged to receive a first end of the shackle, and the second retaining means only being accessable when interior of the casing through a second aperture in the casing, the second aperture being configured and arranged to receive a second end of the shackle, both the first end and the second end of the shackle being releasably securable within the casing by way of the lock means.

Alternatively the shackle can have a first end and a second end, the first end being releasably securable in the aperture in the casing, and the second end being captively mounted within or to the body. Expediently the second end can be fixed mounted to the body.

The shackle may be of any known type, including both rigid type and flexible shackles, examples of the latter being those formed from chain or cable.

Further, the lock means may similarly be of any known type.

Preferably, the shackle is a rigid U-shaped member.

Desirably, the shackle forms part of the electrical circuit of the tamper alarm means and can be provided with an electrically insulative coating to facilitate this function.

BRIEF DESCRIPTION OF THE DRAWINGS

Two presently preferred embodiments of the invention will now be described, by way of example only, with reference to the accompanying drawings, in which:

FIGS. 1 to 5 of the drawings illustrate a first embodiment of the invention, namely, a padlock, as generally indicated at 1, incorporating a tamper alarm. The padlock 1 comprises a body 2 and a shackle 3.

Figure 3:
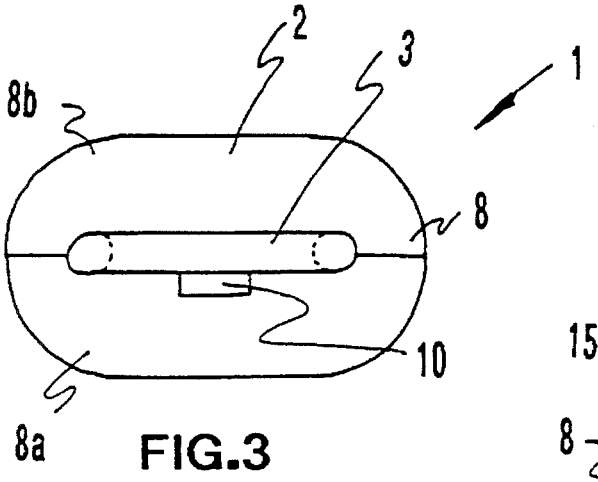
FIG. 3 illustrates a plan view of the padlock of FIG. 1.
Figure 4:
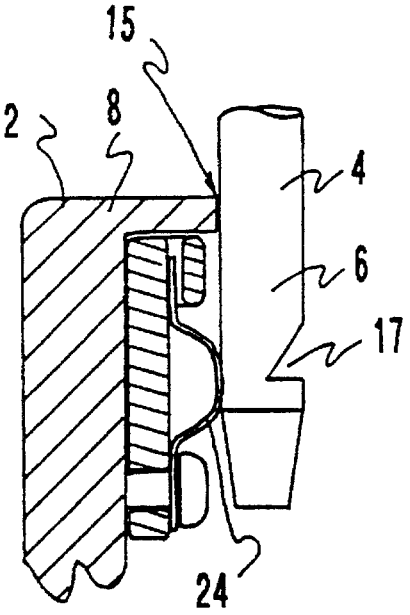
FIG. 4 illustrates a sectional front elevation of part of the padlock of FIG. 1.

The shackle 3 is a rigid U-shaped member having a short leg 4 and a long leg 5. The short leg 4 terminates at a first end portion 6 and the long leg 5 terminates at a second end portion 7 which is adapted to be permanently housed within the body 2.

The body 2 includes an outer casing 8 formed as two interlockable sections 8*a* and 8*b*. The sections 8*a* and 8*b* are substantially symmetrical in shape and appearance and are maintained in interlocked engagement by way of a retaining pin 9. In addition to the retaining pin 9 a plurality of lugs 10 are provided on the interior mating face of each section 8*a*, 8*b* which, when the sections 8*a*, 8*b* are brought together, slidably interlock thereby providing a firm secure connection over all areas of contact between the sections 8*a*, 8*b*.

The retaining pin 9, which is elongate and terminates in a threaded portion 11, links and retains the sections 8*a* and 8*b* in interlocked engagement by way of pairs of lugs 12, one lug 12 on each pair being on each section 8*a*/8*b*. Each lug 12 has an aperture 13 therethrough sized to accommodate the pin 9. The apertures 13 of the various lugs 12 are aligned so that the pin 9 may extend continuously therethrough.

The threaded portion 11 of the pin 9 is screwed into a locking nut 14 which is seated into a recess in each of the sections 8*a* and 8*b*. Access to the pin 9 is only possible by way of an aperture 15 in the casing 8, which aperture 15 is sized to snuggly receive the end portion 6 of the short leg 4 of the shackle 3.

The shackle 3 is mounted so as to permit reciprocal movement relative to the body 2 between a closed, depressed position, in which end portions 6,7 of both legs 4,5 are in the body 2, the end portion 6 being in the aperture 15, and an extended, open position in which the end portion 6 of the short leg 4 is outside the body 2.

A latch mechanism 16, interior of the casing 8, engages a shaped recess 17 in the end portion 6 of the leg 4 of the shackle 3 when the shackle is in the depressed, closed position, thereby preventing the shackle 3 from moving.

Figure 1:
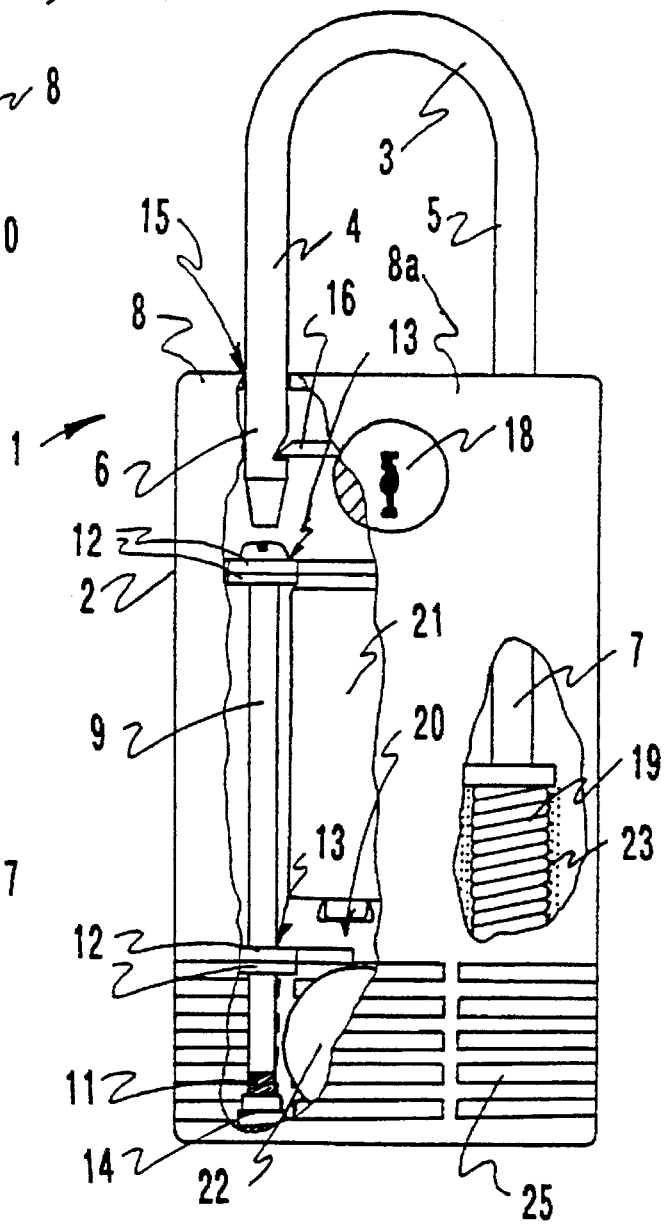
FIG. 1 illustrates a partially cut away front elevation of a padlock in accordance with the present invention.
Figure 5:
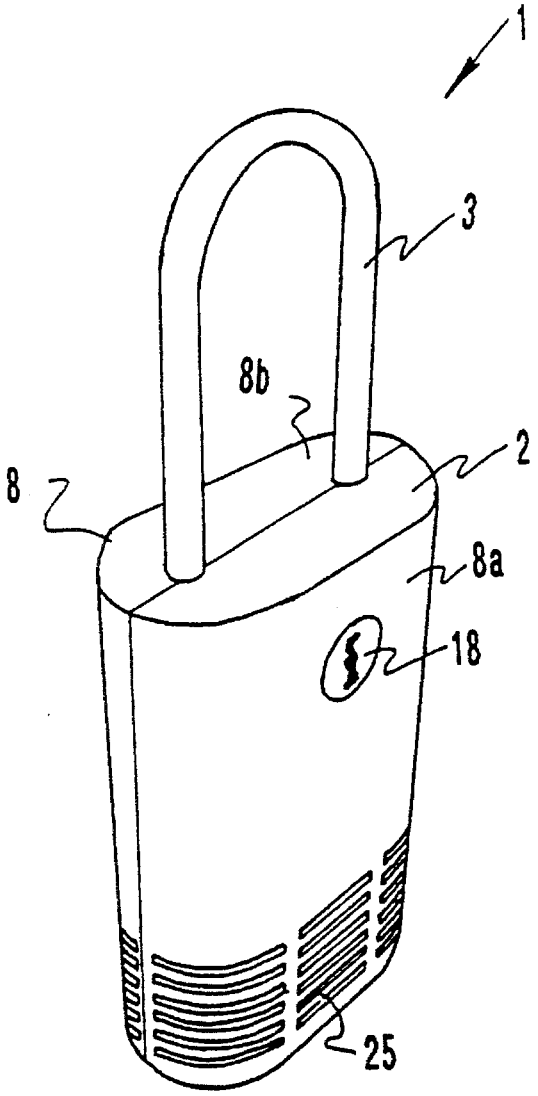
FIG. 5 illustrates a perspective view of the padlock of FIG. 1.
Figure 2:
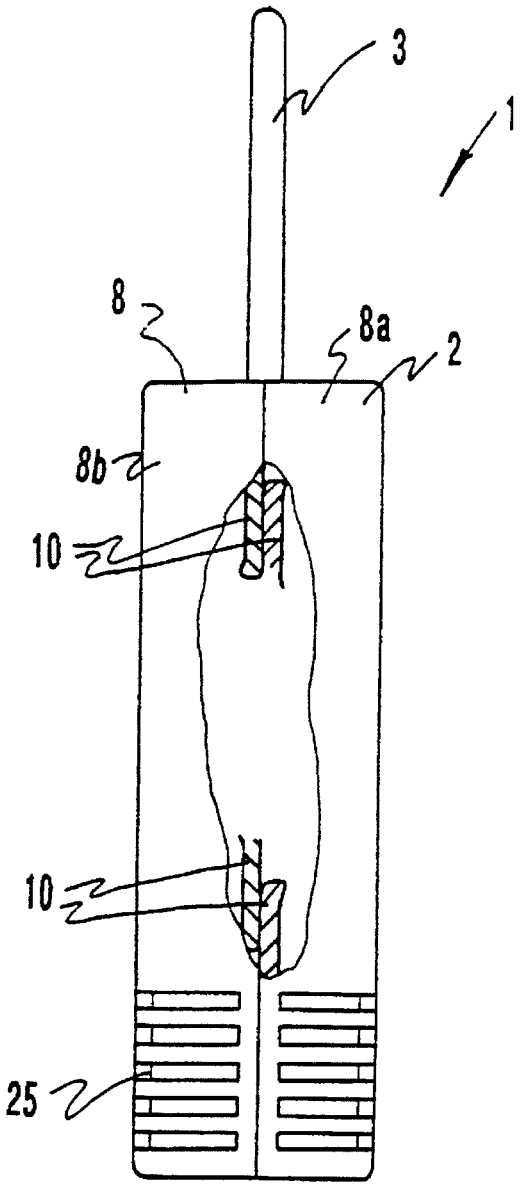
FIG. 2 illustrates a partially cut away side elevation of the padlock of FIG. 1.
Figure 6:
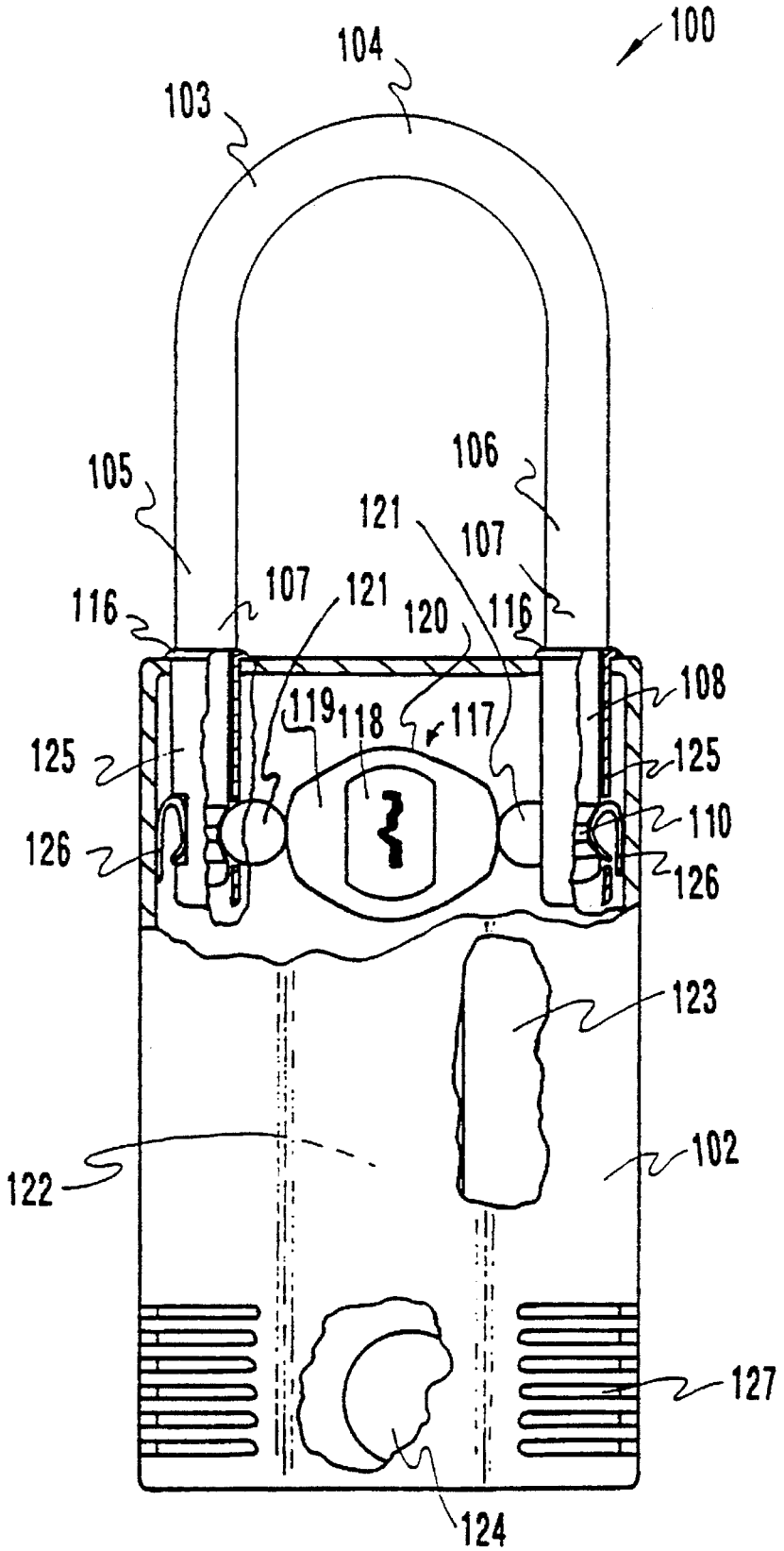
FIG. 6 illustrates a partially cut away front elevation of an alternative padlock in accordance with the present invention.
Figure 8:
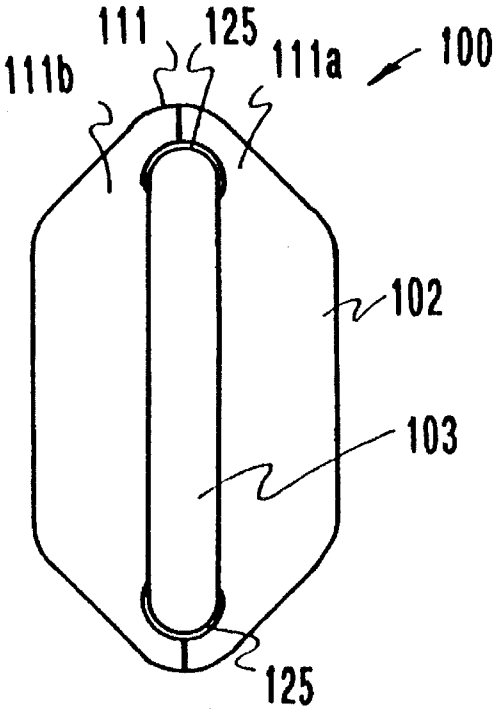
FIG. 8 illustrates a plan view of the padlock of FIG. 6.
Figure 7:
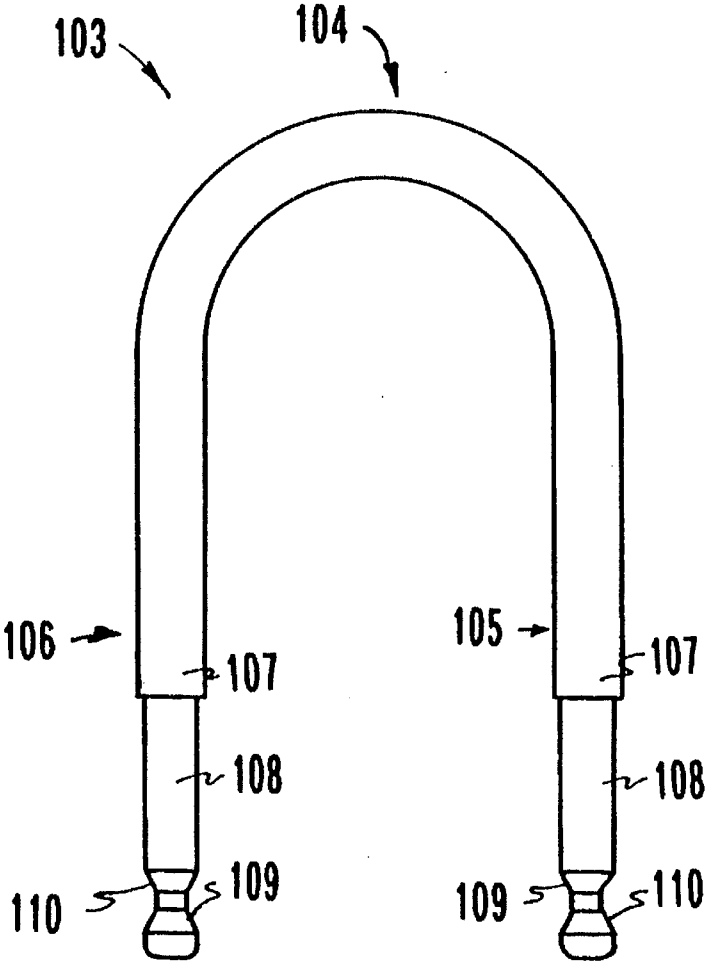
FIG. 7 illustrates a front elevation of the shackle of the padlock of FIG. 6.
Figure 9:
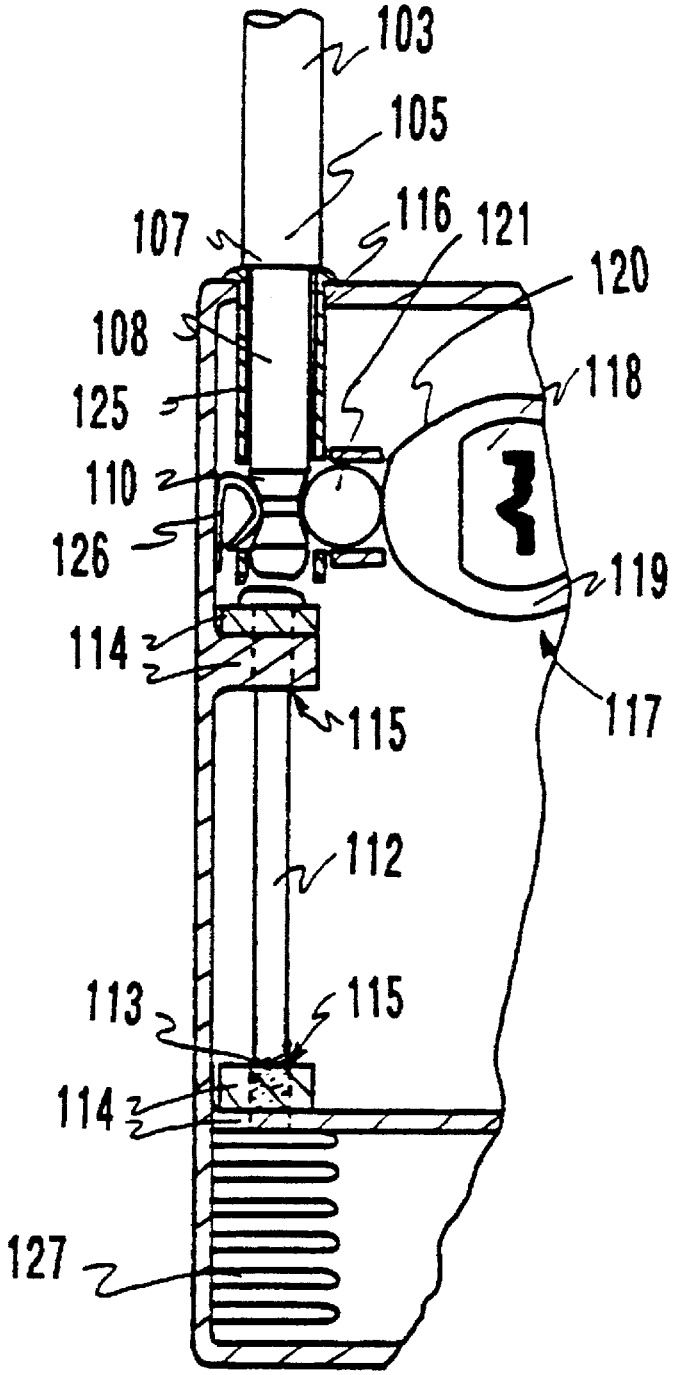
FIG. 9 illustrates a sectional front elevation of part of the padlock of FIG. 6.

A lock arrangement 18, preferably key operated as shown in FIG. 1, is provided to activate the latch mechanism 16 so as to release the shackle 3 and allow it to move to the open position. In the open position the shackle 3 may pivot about the long leg 5. The shackle 3 is biased towards the open position by a spring 19.

A tamper alarm 20 is incorporated into the padlock 1 and is housed entirely within the casing 8. The tamper alarm 20 comprises a power supply 21, for example, a 9 volt battery, an alarm sounding device 22, and an electrical circuit.

The electrical circuit may generally be considered as comprising two portions, the first portion being the control circuitry (not shown) and the second portion being the tamper sensing circuitry.

The spring 19 and shackle 3 form part of the tamper sensing circuitry. Electrical shielding of these components from the body 2 of the padlock 1 is required, and in this connection the spring 19 is sheathed within an insulating sleeve 23 and the shackle 3 is coated with a hard wearing electrically insulative material over substantially its entire surface, save at ends 6,7. To close the tamper sensing circuitry a switch connection 24 is provided adjacent the aperture 15 in the casing 8 which is completed when contacted by the unshielded end 6 of the short leg 4 of the shackle 3.

Enabling and disenabling of the tamper alarm 20 may ultimately only be effected by way of the lock arrangement 18.

In the following description of the operation of the padlock 1 and tamper alarm 20 the alarm sounding device 22 will be referred to as emitting an audible signal. However, as will be appreciated, the alarm sounding device 22 could equally well emit an inaudible signal in the form of a radio or microwave transmission which may be received at some remote location to activate a visual indicator, such as a flashing light, an audible indicator, such as an alarm or horn, or a combination of these two possibilities.

In use, the padlock 1 is mounted in position to secure the desired article of property or area. To achieve this the shackle 3 is depressed to the closed position, whereat the latch mechanism 16 engages the shaped recess 17 in the end portion 6 of the leg 4. In moving to the closed position the end portion 6 closes the tamper sensing circuitry by completing the switch connection 24. As a test feature of the status of the power supply 21 the alarm sounding device 22 desirably emits a short beep or some other such indication each time the switch connection 24 is made.

If the padlock 1 is substantially interferred with, for example by attempting to sever the shackle 3 or prise it open, the tamper sensing circuitry will indicate to the control circuitry and the alarm sounding device 22 will begin emitting an audible signal.

A second embodiment of the invention is illustrated in FIGS. 6 to 9 of the drawings. In these drawings a padlock, as generally indicated at 100, is provided which incorporates a tamper alarm. The padlock 100 comprises a body 102 and a shackle 103.

The shackle 103 includes three identifiable regions.

A central portion 104 for wrapping or placing around or through an object to be secured, and end portions 105 and 106. The end portions 105 and 106 are substantially identical, each having a first section 107 of particular cross-section, a second section 108 of stepped down cross-section and a third section 109 adapted to co-operate with means for locating and retaining the shackle 103 within the body 102. Preferably, both the first and second sections, 107 and 108 respectively, are circular in cross-section, although it will be appreciated that this need not be so by necessity and indeed a square or rectangular cross-section could be adopted. The third section 109 may conveniently comprise a groove 110 around the circumference of the end portion 105,106 in the second section 108. Again, however, other forms are envisaged, such as, for example, a notch or aperture extending in or through the second section 108.

In the drawings the shackle 103 is shown as having a central portion 104 which is rigid and U-shaped, so that the shackle 103 as a whole is rigid and U-shaped. However, alternatives, such as flexible wire or chain could equally well be used, and in some applications would be preferable.

The body 102 includes an outer casing 111 formed as two interlockable sections 111*a* and 111*b*. The sections 111*a* and 111*b* are substantially symmetrical and identical in outward shape and appearance and are maintained in interlocked engagement by way of a pair of retaining pins 112.

The retaining pins 112, which are elongate and terminate in a threaded portion 113. Each retaining pin 112 links and retains the sections 111*a* and 111*b* in interlocked engagement by way of two pairs of lugs 14, one lug 114 on each pair being part of each section 111*a*/111*b*. Each lug 114 has an aperture 114 therethrough sized to receive and accommodate the corresponding pin 112. The apertures 115 of each of the four lugs are aligned so that the corresponding pin 112 may extend therethrough. The threaded portion 113 of each pin 112 is screwed into a locking nut (not shown) which is seated into a recess in each of the sections 111*a* and 111*b*. Access to each pin 112 is only possible by way of a corresponding aperture 116 in the casing 111. The apertures 116 are sized to snuggly receive one or other of the end portions 105,106 of the shackle 103.

A latch mechanism 117 is provided interior of the casing 111 to releasably engage and retain the end portions 105 and 106 of the shackle 103 when inserted into the apertures 116.

The latch mechanism 117 includes a lock arrangement 118, preferably key operated as shown in FIG. 1, to activate engagement and disengagement of the latch mechanism 117 with the end portions 105 and 106 of the shackle 103.

Operation of the lock arrangement 118 causes a cam 119, rotatably mounted thereon, to rotate. The cam surface 120 of the cam 119 acts on a pair of ball bearings 121. Rotation of the cam 119 causes the ball bearings 121 to move between a first position and a second position, or vice versa. With the end portions 105,106 of the shackle 103 located in the corresponding apertures 116 of the body 102, and with the ball bearings 121 causes to move into the final position each ball bearing 121 is engaged with the groove 110 in the corresponding end portion 105,106, thereby locking it in position.

In the second position the ball bearings 121 can move back out of the groove 110 to allow the end portions 105, 106 to be removed.

Positioning of the groove 110 on each of the shackle end portion 105,106 relative to its corresponding ball bearing 121 is achieved utilizing the step down in cross-sectional dimension from the first section 107 to the second section 108; the step bears on the outside of the body 102 adjacent the aperture 116 thereby providing a location.

A tamper alarm 122 is incorporated into the padlock 100 and is housed entirely within the casing 111. The tamper alarm 122 comprises a power supply 123, for example in the form of a 9 volt battery, an alarm sounding device 124, and an electrical circuit.

The electrical circuit may generally be considered as comprising two portions, the first portion being the control circuitry (not shown) and the second portion being the tamper sensing circuitry.

The shackle 103, which is made from a strong and tough electrically conductive material, such as brass or stainless steel, forms part of the tamper sensing circuitry. Electrical shielding of this component from the body 102 of the padlock 100 is required, and in this connection an insulating sleeve 125 is provided for each aperture 116 to separate the end portions 105,106 of the shackles 103 from the body 102. The shackle 103 itself may be coated with a hard wearing electrically insulative material over substantially its entire surface, save at end portions 105,106. However, because the power drawn by the tamper sensing circuit is so low it has been noted that a special insulative coating is not always necessary, and indeed weathering of the shackle 103 to create a thin oxide outer layer is often sufficient to satisfy any requirements in this regard. To close the tamper sensing circuitry a switch connection 126 is provided adjacent each aperture 116 in the casing 111 which is completed when contracted by end portions 105,106.

Enabling and disenabling of the tamper alarm 122 may ultimately only be effected by way of the lock arrangement 118. Preferably, the key cannot be removed without enabling the tamper alarm 122.

In the following description of the operation of the padlock 100 and tamper alarm 122 the alarm sounding device 124 will be referred to as emitting an audible signal. However, as will be appreciated and as noted above in respect of the first preferred embodiment, the alarm sounding device 124 could equally well emit an inaudible signal in the form of a radio transmission which may be received at some remote location to activate a visual indicator, such as a flashing light, an audible indicator, such as an alarm or horn, or a combination of these two possibilities.

In use, the padlock 100 is mounted in position to secure the desired article of property or area. To achieve this the end portion 105,106 of the shackle 103 are inserted into the apertures 116, whereafter the latch mechanism 117 can be engaged and the key removed. As with the previously described embodiment, as a test feature of the status of the power supply 123 the alarm sounding device 24 desirably emits a short beep or some other such indication each time the switch connections 126 are made. If the padlock 100 is substantially interferred with, for example by attempting to sever the shackle 103 or prise it open, the tamper sensing circuitry will indicate to the control circuitry and the alarm sounding device 124 will begin emitting an audible signal.

Referring now to both preferred embodiments, the control circuitry is desirably designed such as to ensure that even if the tamper sensing circuitry is recompleted, for example by utilising auxiliary wiring, the audible alarm signal will continue to be emitted either for a predetermined time period, until the power supply fails, or until disabled by an authorised person using the lock arrangement.

There are at least two features of the preferred embodiments which provide significant advantage. Firstly, with the shackle itself forming part of the electrical circuit any severing thereof will result in the alarm sounding device generating an alarm signal. Secondly, the outside of the padlock is specifically designed so as to be symmetrical in appearance. The net effect of this is that it is not obvious where the various components of the tamper alarm lie within the casing. Therefore attempting to break into the padlock to disable the alarm will take extra time during which, of course, the alarm sounding device will generate an audible alarm signal.

When the alarm sounding device 22(124) is of a form which emits an audible signal, a grill 25(127) may be provided to maximise the volume of signal heard. Desirably, there is provided an accoustically transparent membrane (not shown) over the interior surface of the grill 25(127) to prevent entry of a liquid which might otherwise disable the tamper alarm 20(122). Further in this connection, the various components of the tamper alarm 20(22) should be encased in waterproof material such as a putty or like substance.

Additional advantages of the present invention will become apparent to those skilled in the art after considering the principles in particular form as discussed and illustrated.

Accordingly, it will be appreciated that changes may be made to the above described embodiment of the invention without departing from the principles taught herein.

In this connection, the casing need not separate symmetrically into portions and, further, the portions may screw or twist lock together instead of using lugs, the retaining means preventing untwisting. Furthermore, the casing may be of any appropriate shape.

Moreover, the second end of the shackle may be fixed, mounted to the body, and possibly at a different face of the body from that of the first shackle end.

Finally, it will be understood that this invention is not limited to the particular embodiment described or illustrated, but is intended to cover all alterations, additions or modifications which are within the scope of the appended claims.

I claim:

1. A padlock comprising a shackle and a body, the shackle having an end releasably securable in the body, the body having a casing which is divided into two portions, each of which comprises substantially half the casing, the casing housing a tamper alarm means and a lock means, the tamper alarm means including a power supply means, the casing having an aperture configured and arranged to receive the end of the shackle, the end of the shackle being securable in the aperture by way of the locking means, one of the casing portions being removable to enable access to the power supply means, the removable portion being held in place by a retaining means, the retaining means only being accessible for retaining or releasing the removable portion of the casing via the aperture in the casing configured and arranged to receive the end of the shackle, the removable portion of the casing being configured and arranged so as to avoid indicating the location within the padlock body of the power supply means.

2. A padlock according to claim 1, wherein the shackle has a first end and a second end, the first end being releasably securable in the aperture in the casing, and the second end being captively mounted within or to the body.

3. A padlock according to claim 1, wherein the shackle is a substantially flexible member having a first end and a second end, the first end being releasably securable in the padlock body and the second end is fixed mounted to the padlock body.

4. A padlock according to claim 1, wherein the casing portions are interlocking and are maintained in contiguity by the retaining means.

5. A padlock according to claim 4, wherein the casing is substantially symmetrical.

6. A padlock according to claim 1, wherein the tamper alarm means includes tamper sensing circuitry, and wherein the shackle is formed from an electrically conductive material and comprises part of said tamper sensing circuity.

7. A padlock according to claim 6, wherein the shackle is coated, save at its end, in an electrically insulative material.

8. A padlock according to claim 6, wherein the camper alarm means further includes control circuitry and a signal generator to generate an alarm signal, such that when the tamper sensing circuitry has sensed tampering with the padlock the control circuitry generates an alarm signal, the alarm signal being either an audible signal, a radio signal, or a microwave transmission.

9. A padlock according to claim 1, wherein the tamper alarm means is substantially encased in a water proof material.

10. A padlock according to claim 9, wherein the signal generator emits the alarm signal through a grill in the casing, which grill is covered over its interior surface with an acoustically transparent membrane.

11. A padlock comprising a shackle and a body, the shackle having first and second ends releasably securable in the body, the body having a casing which is divided into two portions, each of which comprises substantially half the casing, the casing housing a tamper alarm means and a lock means, the tamper alarm means including a power supply means, the casing having an aperture configured and arranged to receive the first end of the shackle, the first end of the shackle being securable in the aperture by way of the locking means, one of the casing portions being removable to enable access to the power supply means, the removable portion being held in place by a retaining means, the retaining means only being accessible for retaining or releasing the removable portion of the casing via the aperture in the casing configured and arranged to receive the first end of the shackle, the removable portion of the casing being configured and arranged so as to avoid indicating the location within the padlock body of the power supply means.

12. A padlock according to claim 11, wherein the casing is substantially symmetrical.

13. A padlock according to claim 11, wherein the removable portion of the casing is held in place by a first and a second remaining means, both located interior of the casing, the first retaining means only being accessible when interior of the casing through a first aperture in the casing, the first aperture being configured and arranged to receive the first end of the shackle, and the second retaining means only being accessible when interior of the casing through a second aperture in the casing, the second aperture being configured and arranged to receive the second end of the shackle, both the first end and the second end of the shackle being releasably securable within the casing by way of the lock means.

14. A padlock according to claim 3, wherein the casing portions are interlocking, and are maintained in contiguity by the retaining means.

15. A padlock according to claim 11, wherein the tamper alarm means includes tamper sensing circuitry, and wherein the shackle is formed from an electrically conductive material and comprises pare of said tamper sensing circuitry.

16. A padlock according to claim 15, wherein the shackle is coated, save at its end, in an electrically insulative material.

17. A padlock according to claim 15, wherein the tamper alarm means further includes control circuitry and a signal generator to generate an alarm signal, such that when the tamper sensing circuitry has sensed tampering with the padlock the control circuitry will generate an alarm signal, wherein the alarm signal is either an audible signal, a radio signal, or microwave transmission.

18. A padlock according to claim 11, wherein the tamper alarm means is substantially encased in a water proof material.

19. A padlock according to claim 18, wherein the signal generator emits the alarm signal through a grill in the casing, which grill is covered over its interior surface with an acoustically transparent membrane.

20. A padlock comprising a shackle and a body, the shackle having an end releasably securable in the body, the body having a substantially symmetrical casing which is divided into two portions, each of which comprises substantially half the casing, the casing housing a tamper alarm means and a locking means, the tamper alarm means including a power supply means, the casing having an aperture configured and arranged to receive the end of the shackle, the end of the shackle being securable in the aperture by way of the locking means, one of the casing portions being removable to enable access to the power supply means, the removable portion being held in place by a retaining means, the retaining means only being accessible for retaining or releasing the removable portion of the casing via the aperture in the casing configured and arranged to receive the end of the shackle, the removable portion of the casing being configured and arranged so as to avoid indicating the location within the padlock body of the power supply means.

* * * * *

UNITED STATES PATENT AND TRADEMARK OFFICE
CERTIFICATE OF CORRECTION

PATENT NO. : 5,587,702

DATED : December 24, 1996

INVENTOR(S) : Garth R. Chadfield

It is certified that error appears in the above-identified patent and that said Letters Patent is hereby corrected as shown below:

Column 4, line 48, after "lugs", replace "14" with --114--;

Column 6, line 35, after "alarm", replace "20(22) with --20(122)--;

Column 7, line 29, claim 8, after "the", replace "camper" with --tamper--;

Column 8, line 5, claim 13, after "both", replace "located" with --locatable--;

Column 8, line 23, claim 15, after "comprises", replace "pare" with --part--.

Signed and Sealed this

Twenty-sixth Day of August, 1997

*Attest:*

Bruce Lehman

BRUCE LEHMAN

*Attesting Officer*

*Commissioner of Patents and Trademarks*